United States Patent [19]

MacDonald

[11] Patent Number: 4,947,148

[45] Date of Patent: Aug. 7, 1990

[54] ELECTRICAL CUT-OFF DEVICE

[76] Inventor: Francis D. MacDonald, 22 Glenhill Place, Guelph, Ontario, Canada, N1E 4G7

[21] Appl. No.: 350,561

[22] Filed: May 11, 1989

[51] Int. Cl.[5] ..... H01H 71/10; H01H 71/20

[52] U.S. Cl. ..... 337/172; 337/169; 337/180

[58] Field of Search ..... 337/172, 173, 174, 169, 337/180, 181, 217, 218

[56] References Cited

U.S. PATENT DOCUMENTS

| | | | |
|---|---|---|---|
| 1,821,761 | 9/1931 | Lemmon | 337/180 |
| 2,651,694 | 9/1953 | Lindell | 337/169 |
| 2,901,573 | 8/1959 | Gesellschap | 337/169 |

FOREIGN PATENT DOCUMENTS

| | | | |
|---|---|---|---|
| 355797 | 8/1931 | United Kingdom | 337/180 |

*Primary Examiner*—H. Broome

*Attorney, Agent, or Firm*—Thomas A. O'Rourke

[57] ABSTRACT

A horizontally mounted electrical cut-out device is provided. The device includes an insulator electrically isolating a pair of terminals and a fuse assembly comprising a fuse carrier housing a fuse element removably connected between the terminals. The fuse assembly is pivotally connected at one end to one of the terminals to allow the other end of the fuse assembly to engage the other terminal when the fuse assembly is pivoted. The pivotal connection is such so as to permit the fuse assembly to drop automatically to an open position following an interruption resulting from an overload or fault thereby establishing an open circuit condition. This increases safety and provides a visible indication of the open circuit condition. A latch is provided on the other terminal to engage releasably the other end of the fuse assembly to maintain the electrical connection between the two terminals.

19 Claims, 7 Drawing Sheets

ELECTRICAL CUT-OFF DEVICE

The present invention relates to fuses and in particular to an electrical cut-out device.

Electrical cut-out devices are used to provide fusible connections in high voltage power lines in order to break the electrical connection between a pair of power lines when an overload occurs. Typically, the cut-out devices are vertically mounted to a utility pole and comprise an insulator electrically isolating upper and lower terminal assemblies receiving the power lines. A cylindrical fuse carrier having an arc quenching liner houses a fuse element and extends between the terminals in parallel with the insulator. A pivotal connection for the fuse carrier is usually provided in the lower terminal assembly in the form of a shallow downwardly extending slot to allow the fuse carrier to be engaged releasably to the lower terminal assembly. The fuse carrier, when positioned in the slot can then be swung upwards to engage with the upper terminal assembly, thereby forming an electrical connection between the power lines.

When a current overload occurs, the fuse element and the arc quenching liner vaporize to break the electrical connection between the upper and lower terminal assemblies. The vaporized element and liner create a large internal pressure in the fuse carrier and are forced out of the lower end of the fuse carrier.

However, since the liner and fuse element vapour is discharged downwardly, the possibility of injuring a passerby or damaging equipment located beneath the cut-out device is of concern. Also, since the fuse carrier is seated in a shallow slot, the fuse carrier may disengage from the slot when the fuse carrier releases from the upper terminal assembly and swings downwardly after an overload occurs.

The horizontal mounting of cut-out devices has been considered. In particular, U.S. Pat. No. 2,113,632 to Steinmayer shows a horizontally mounted low voltage cut-out device including a fuse carrier connected across a pair of terminal assemblies. To facilitate the connection, one of the terminals is provided with a horizontal slot having a pair of upwardly extending hooks forming an open outer end. The outer end of the slot receives the fuse carrier allowing it to be slid towards the terminating end of the slot and pivoted so that the other end of the fuse carrier can be bolted to the other terminal assembly in order to complete the circuit between the power lines.

However, a problem exists in that the fuse carrier is not easily disengaged from the other terminal assembly and thus, the time required to replace the fuse element housed in the fuse carrier is increased. Another problem exists in the Steinmeyer device in that although the provision of the horizontal slot permits the fuse carrier to slide longitudinally along the slot, the user is required to bias the fuse carrier against the terminating end of the horizontal slot when pivoting the fuse carrier in order to connect the other end of the fuse carrier with the other terminal assembly. Thus, the slot fails to aid in positioning the fuse carrier when pivoting for engagement across the terminal assemblies and to locate the fuse carrier securely to withstand the forces imposed in service. Moreover, another problem exists in that the Steinmayer device cannot be re-fused with the power lines energized. Accordingly, there is a need for an improved electrical cut-out device.

It is therefore an object of the present invention to obviate or mitigate the above disadvantages.

According to the present invention there is provided an electrical cut-out device for electrically connecting a pair of power lines interconnected by an insulator comprising:

an insulator for interconnecting a pair of power lines;

a pair of conductive terminals each for receiving one of said power lines, each of said terminals extending downwardly from one end of said insulator and defining outwardly and inwardly facing sides, one of said terminals having a steep downwardly extending passageway formed therein, said passageway including an open end formed in the outwardly facing side and being shaped at the other end thereof to define a bearing surface;

releasable latch means located on the other said terminals; and a fusible link connectable in a substantially horizontal operative position between said terminals to connect electrically said terminals and one of said fusible link including means for slidably engaging in said passageway when said means is aligned with said open end, said fusible link being pivotal in said passageway when said means is positioned at the other end of said passageway to engage releasably the other end of said fusible link with said latch means.

Preferably, the passageway is steeply angled relative to the longitudinal axis of the fusible link to provide an abutment surface to inhibit longitudinal movement of the fusible link when it is connected across the terminals. The provision of the steeply angled passageway also provides a bias for the fusible link perpendicular to the longitudinal axis of the link to maintain the link in the passageway when the link is disengaged from the latch means. Furthermore, it is also preferred that the fusible link is provided with a cam surface at the one end and the one terminal is provided with a resilient retainer such that upon pivotal movement of the fusible link to engage the other end of the fusible link with the latch means, the one end of the link contacts the resilient retainer and is biased in a direction along the axis of the fuse carrier towards the latch means.

These features allow the present device to be mounted horizontally on a utility pole or positioned in an in-line condition to increase safety in the event of an arc quenching liner and fuse element vapour discharge while facilitating the removal and engagement of the fusible link across the electrically isolated terminals.

An embodiment of the present invention will now be described, by way of example only, with reference to the accompanying drawings in which.

Figure 1:
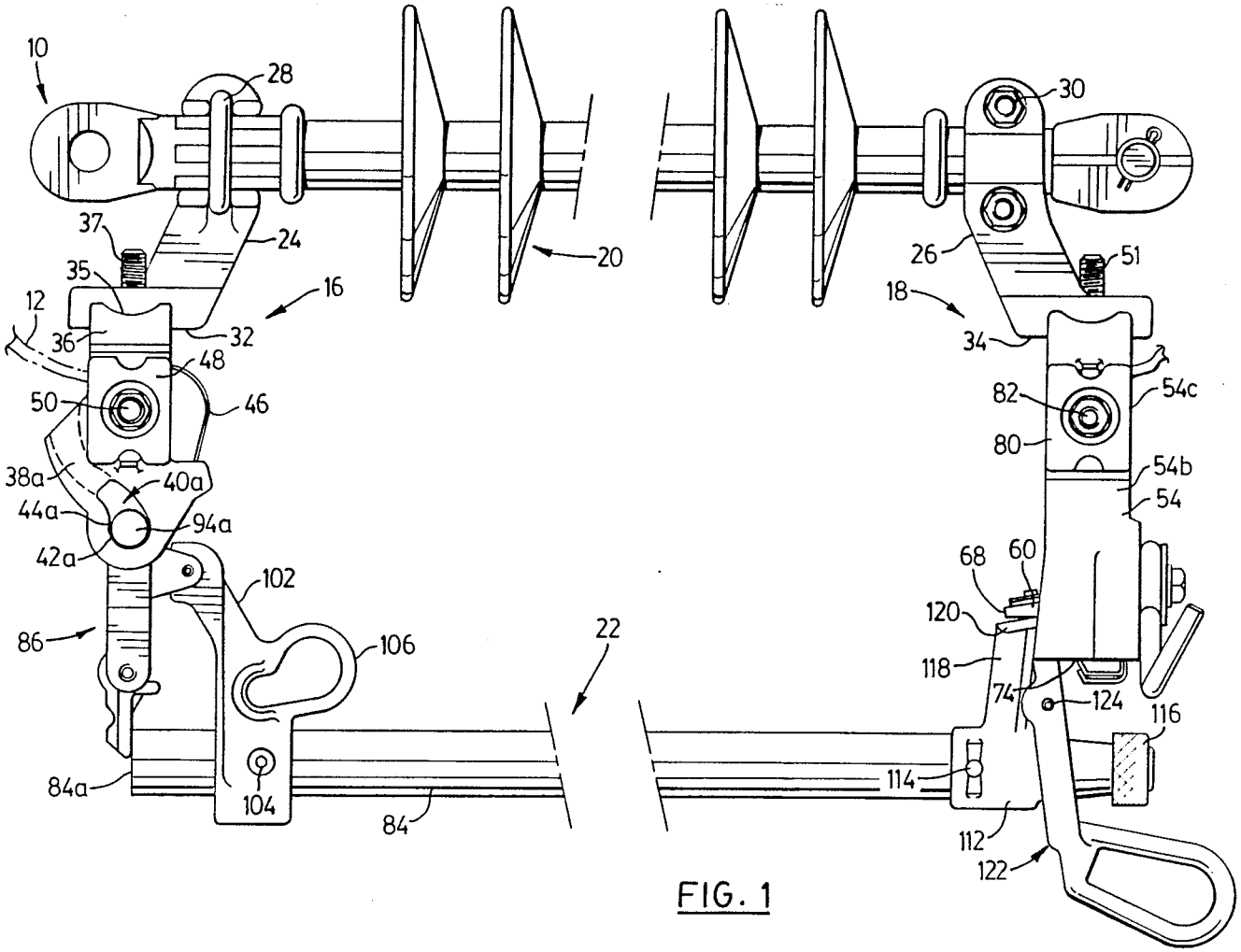
FIG. 1 is a side view of an electrical cut-out device.
Figure 2:
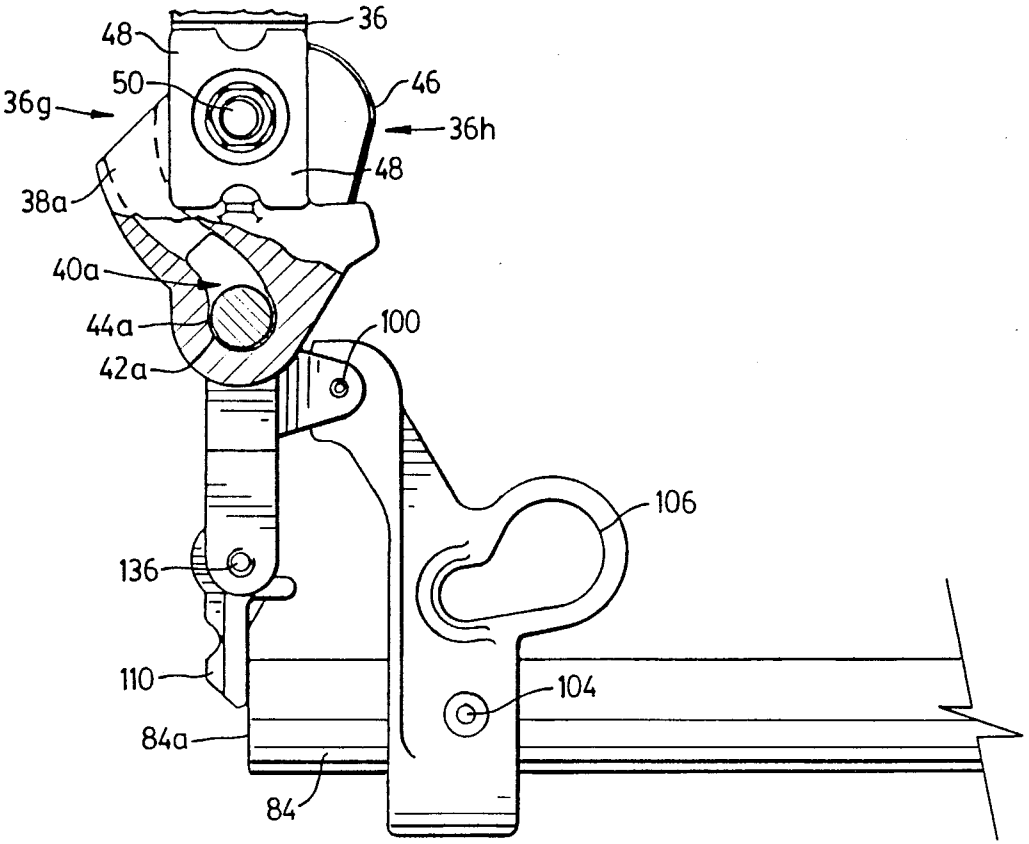
FIG. 2 is an enlarged side view partly in section of a portion of the device illustrated in FIG. 1.
Figure 3:
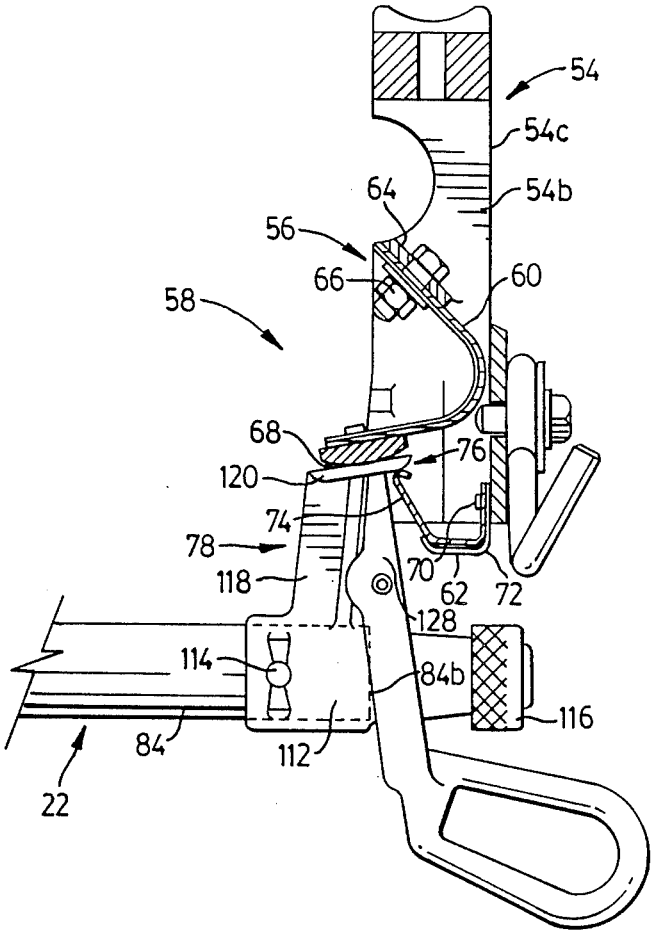
FIG. 3 is an enlarged side view partly in section of another portion of the device illustrated in FIG. 1.
Figure 4:
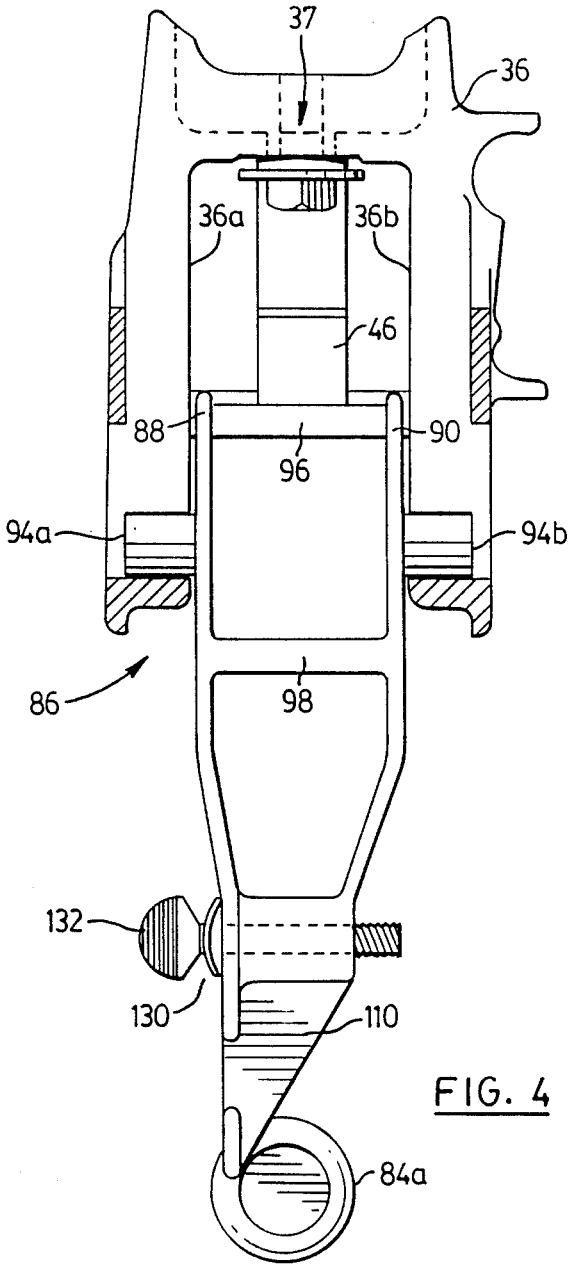
FIG. 4 is an enlarged rear view of the portion illustrated in FIG. 3.
Figure 5:
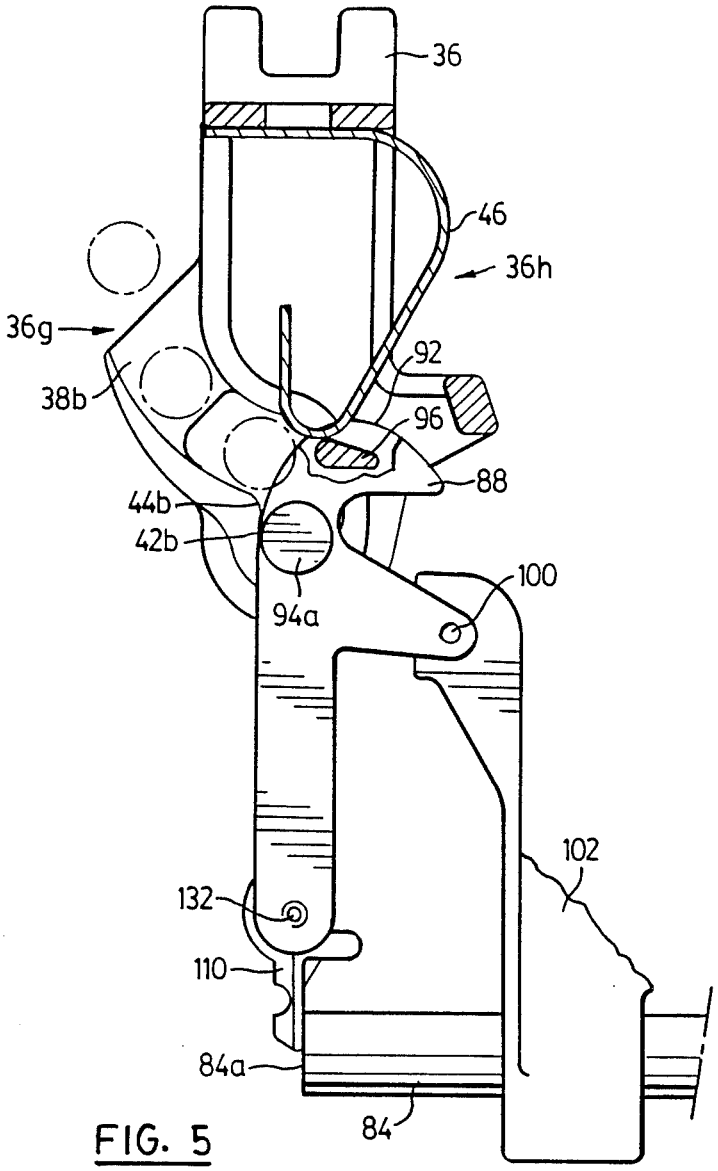
FIG. 5 is another enlarged side view partly in section of the portion illustrated in FIG. 3.

Referring to the Figures, an electrical cut-out device 10 is shown interconnecting a pair of power lines 12 and 14. The cut-out device 10 includes a pair of terminal assemblies 16 and 18 receiving the power lines 12 and 14. The terminal assemblies are mounted on opposite ends of an insulation 20 which electrically isolates the power lines 12 and 14. A fuse assembly 22 extends between the terminal assemblies 16 and 18 to complete the electrical circuit between the two power lines 12 and 14 while functioning to interrupt the electrical circuit in the event of a current overload.

The terminal assemblies 16 and 18 include aluminum brackets 24 and 26 coupled at one end to insulator 20 and projecting downwardly sufficiently from the insulator 20 to provide clearance between the fuse assembly 22 and the insulator 20.

The brackets 24 and 26 are secured to the insulator 20 by "U"-shaped bolts 28 and 30 and have curved lower surfaces 32 and 34 respectively, each lower surface being provided with a tapped bore. The lower surface 32 is coupled to the mating top surface 35 of a bifurcated coupling 36 formed from copper via a bolt 37 which threadably engages with the bore. The coupling 36 is tin coated in suitable areas to preclude the galvanic reaction between the copper coupling and the aluminum bracket. The coupling 36 includes a pair of spaced side walls 36*a*, 36*b* and outwardly and inwardly facing sides 36*g*, 36*h* respectively. The interior surfaces of the side walls 36*a* and 36*b* are each provided with a curved passageway 38*a* and 38*b* respectively, in the form of a channel with each passageway having an opening near the upper portion of the coupling 36 in the outwardly facing side 36*g* of the coupling 36 adjacent. The passageways 38*a*, 38*b* serve to receive one end of the fuse assembly 22 and are sufficiently deep to inhibit accidental disengagement with the fuse assembly.

The curved passageways 38*a* and 38*b* are inwardly and steeply angled with respect to a horizontal axis and terminate in substantially vertical portions 40*a* and 40*b* positioned on the longitudinal axis of the coupling 36. The vertical portions 40*a* and 40*b* are of sufficient depth to provide bearing surfaces 42*a* and, 42*b* for facilitating rotation of the fuse assembly 22 and to provide abutment surfaces 44*a* and 44*b* for preventing movement of the fuse assembly 22 along its longitudinal axis when engaged across the two terminal assemblies 16 and 18. A curved resilient retainer 46 is secured at one end to the coupling 36 by the bolt 37 and is positioned between the two sides 36*a* and 36*b* of the coupling 36. This provides additional support to prevent movement of the fuse assembly 22 along its longitudinal axis when coupled in an operative position and forms an auxiliary electrical contact between the terminal assembly 16 and the fuse assembly 22. A securing plate 48 is removeably secured to one side of the coupling 36 by a nut and bolt 50 to allow the power line 12 to be pinned between the plate 48 and the coupling 36.

A copper latch housing, is secured to the bracket 26 by a bolt 51 threadably engaged with the tapped bore so that the top surface 52 of the housing mates with the curved lower surface 34 of the bracket. The latch housing is also tin coated in suitable areas. The housing 54 has a pair of sidewalls 54*a* and 54*b* and a backwall 54*c* and supports the female portion 56 of a latch 58. The latch 58 includes a pair of curved resilient plates 60 and 62 The plate 60 is secured to a support 64 located in the housing 54 by a nut and bolt 66 and is biased towards and positioned to provide an abutment surface 68 capable of being displaced upwardly against the bias.

The other resilient plate 62 is secured at one end is to the backwall 54*c* by a connector 70 and positioned below the plate 60. The plate 62 is supported along a portion of its length by a support 72. The other end 74 of the plate 62 is disposed adjacent the plate 60 and is capable of being displaced towards the backwall 54*c* against the bias. The abutment surface 68 and the other end 74 are separated to provide an aperture 76 for receiving the male portion 78 of the latch 58 located on the fuse assembly 22. A second securing plate 80 is removeably secured to the sidewall 54*a* by a nut and bolt 82 to allow the power line 14 to be pinned between the plate 80 and the housing 54.

The fuse assembly 22 comprises a cylindrical fuse carrier 84 having an inner arc quenching liner and is connected at one end 84*a* to a bifurcated connector 86. The connector 86 includes a pair hooked extensions 88 and 90 shaped to form a cam surface 92 for cooperation with the coupling 36 in a manner to be described herein.

The sides of the connector 86 are provided with outwardly extending trunnions 94*a* and 94*b*. The trunnions 94*a* and 94*b* are positioned and dimensioned to engage slidably in the passageways 38*a* and 38*b* and to form a pivotal connection between the fuse assembly 22 and the coupling 36. Crossbars 96 and 98 interconnect the extensions 88 and 90. The crossbar 96 engages with the resilient retainer 46 when the fuse assembly 22 is pivoted in the coupling 36 to engage the fuse assembly 22 with the terminal assembly 18.

The connector 86 is secured by pivot pin to a bracket 102 formed on the fuse carrier 84. The bracket 102 encircles the fuse carrier 84 to define a hinge 100 and is secured thereto by a suitable fastener 104. The bracket 102 also includes a lifting ring 106 to facilitate removal and the placement of the fuse assembly from or on the coupling 36. The connector 86 terminates at its lower end to form an abutment member 110 which abuts against the open end 84*a* of the fuse carrier 84 when the fuse assembly is in an operative position. The hinge 100 is biased by a spring (not shown) in a direction to force the abutment member 110 away from the fuse carrier 84 when the member 110 is not restrained by a fuselink.

A male portion 78 of the latch 58 is secured to the other end 84*b* of the fuse carrier 84. The male portion 78 includes a housing 112 receiving the fuse carrier 84 and is secured to the carrier 84 by a suitable fastener 114. One end of the housing 112 is provided with threads to receive an end cap 116 which seals one end of the fuse carrier 84. A post 118 extends upwardly from the housing 112, the upper surface of which defines an engagement plate 120. The plate 120 is at a slight angle to the horizontal and is dimensioned to extend outwardly beyond the sides of the post 118, thereby exposing a portion of its undersurface. The engagement plate 120 is also of a thickness greater than the separation distance or aperture 76 formed between the two plates 60 and 62.

The male portion 78 also includes an arm 122 pivotally connected to the post 118 by a hinge pin 124. The arm 122 terminates at one end in a pull ring 126 which is positioned below the fuse carrier 84 to facilitate access. The other end 128 of the arm 122 extends upwardly along side the post 118 and is biased thereagainst by a spring (not shown).

A third securing plate 130 is removeably held against the abutment member 110 by a bolt 132 to allow one end of a fuse cable 134 to be secured to the connector 86. The fuse cable 134 as is well known in the art, extends into the fuse carrier 84 and is coupled to one end of a fuse element (not shown). The other end of the fuse element extends through the fuse carrier 84 to the other end thereof. The fuse element is held in electrical contact with the male portion 78 of the latch 58 by the end cap 116. The connection of the fuse cable 134 to the member 110 at one end and to the end cap 116 at the other end counters the bias of the hinge 100 which acts to force the abutment member 110 away from the fuse carrier. Thus, the fuse cable 134 when intact maintains the abutment member 110 against the open end 84*a* of the fuse carrier.

The connection and operation of the cut-out device 10 will now be described. Firstly, the terminal assemblies 16 and 18 of the cut-out device 10 are secured to either ends of the insulator 20 so that they depend therefrom. The power lines 12 and 14 are then secured to the respective terminal assemblies 16 and 18 by the securing plates 48 and 80. Prior to connecting the fuse carrier and fuse cable across the terminal assemblies 16 and 18, the end cap 116 is removed from the housing 112. The fuse element and fuse cable 134 are inserted into fuse carrier 84 so that the fuse cable extends beyond the open one end 84*a* and the fuse element abuts against the other end 84*b* of the fuse carrier 84. The end cap 116 is then threadably engaged with the housing 112 to secure the fuse element and cable 134 in the fuse carrier. The end of the fuse cable 134 extending from the open end 84*a* of the carrier is then pinned to the abutment member 110 by the securing plate 130 which acts against the bias of the hinge 100 to hold the open end 84*a* against the member 110.

With this complete, the fuse assembly 22 is held via the lifting ring 106. The lifting ring 106 is positioned relative to the center of gravity of the fuse assembly 22 so that the fuse assembly 22 assumes a substantially vertical orientation. With the fuse assembly in this orientation, the assembly is positioned to bring the trunnions 94*a* and 94*b* into alignment with the open end of the passageways 38*a* and 38*b* provided in the outwardly facing side 36*g* of the coupling 36. With the trunnions aligned, the fuse assembly 22 is slid downwardly so that the trunnions 94*a* and 94*b* move along the passageways until they rest at the bottom of the passageways in the vertical sections.

The cam surface 92 defined by the extensions 88 and 90 allows the connector 86 to engage with the coupling 36 without contacting the retainer 46 whilst permitting the crossbar 96 to contact the retainer 46 when the fuse assembly 22 is in a substantially horizontal orientation. Moreover, the design of the extensions 88, 90 and the passageways 38*a*, 38*b* only permits the trunnions 94*a*, 94*b* to slide to the bottom of the passageways when the fuse assembly 22 is in a substantially vertical orientation. This prevents the fuse assembly 22 from making an engaged connection between the two terminal assemblies 16 and 18 when the fuse assembly 22 is not seated properly in the passageways.

When the trunnions 94*a* and 94*b* are seated at the bottom of the passageways, the fuse assembly 22 is swung upwardly. The depth of the vertical sections 40*a* and 40*b* provide bearing surfaces 42*a* and 42*b* and facilitate the pivoting motion of the fuse assembly 22 by maintaining the position of the trunnions in the passageways. When fuse assembly 22 is swung upwardly, the outer edge the engagement plate 120 abuts against the other end 74 of the resilient plate 62 forcing it to move laterally into the housing 54 against the bias. When this occurs, the engagement plate 120 is capable of further upward movement, thereby allowing the top surface of the plate 120 to abut against the abutment surface 68 of the plate 60 causing its displacement upwardly against the bias.

After the plate 60 has been displaced upwardly by a distance sufficient to form an aperture 76 between the plates 60 and 62 greater in thickness than the plate 120, the outer edge of the engagement plate 120 no longer biases the resilient plate 62 into the housing. This allows the resilient plate 62 to spring back towards the post 118 beneath the plate 120. When the upward force imposed on the fuse assembly 22 subsides, the plate 60 forces the engagement plate 120 towards the lower plate 62. This action results in the plate 120 being held between the plate 62 and the surface 68 thereby securing the male portion 78 to the female portion 56 and completing an electrical connection between the power lines 12 and 14 via the assemblies 16, 22 and 18.

To release the connection between the resilient plates 60 and 62 and the engagement plate 120, the pull ring 126 is pulled downward thereby pivoting the arm 120 via hinge 124. The pivoting action forces the other end 128 of the arm 120 to abut against the resilient plate 62 causing it to move laterally into the housing 54. When the other end 128 of the arm has moved the plate 62 beyond the outer edge of the engagement plate 120, the fuse assembly 22 is released from the housing 54. With the fuse assembly released from the terminal assembly 18, the assembly 22 is capable of swinging under the influence of gravity via its pivotal connection with the terminal assembly 16. In this position, the fuse assembly 22 can be disengaged from the coupling 36 by engaging the lifting ring 106 and sliding the trunnions 94*a* and 94*b* upwardly through the passageways.

When the cut-out device 10 is connected across the power lines and an overload occurs, the arc quenching liner and the fuse element vaporize and due to the increase in pressure within the fuse carrier 84 are jettisoned outwardly through the open end 84*a* of the fuse carrier in the case of a low fault overload and outwardly through both ends in the event of a high fault overload if the internal pressure attained in the fuse carrier is sufficient to blow out the end cap 116.

When the fuse element vaporizes, the tension in the fuse cable 134 is released. This allows the spring to force the abutment member 110 away from the fuse carrier via the hinge 100. As the member 110 and carrier are forced apart, since the trunnions 94*a*, 94*b* remain seated in the bottom of the passageways 38*a*, 38*b*, the connector 86 pivots within the passageways via the trunnions which in turn swings the hinge 100 in an arc away from the terminal assembly 18.

The movement of the hinge 100 in this manner forces the plate 120 to slide between the two plates 60 and 62 and out of the aperture 76. When the plate 120 slides a sufficient distance to clear the plate 62, the fuse assembly 22 becomes disengaged from the terminal assembly 18 and is free to swing downwardly via the pivotal connection with assembly 16 under the influence of gravity. Since, the passageways 38*a*, 38*b* are sufficiently deep, there is little or no chance of the fuse assembly 22 accidentally disengaging from the terminal assembly 16 as it swings. Accordingly, since the fuse assembly 22 frees itself from the terminal assembly 18 when an overload occurs, the device 10 gives a visual indication of the occurrence of a fault.

Figure 6:
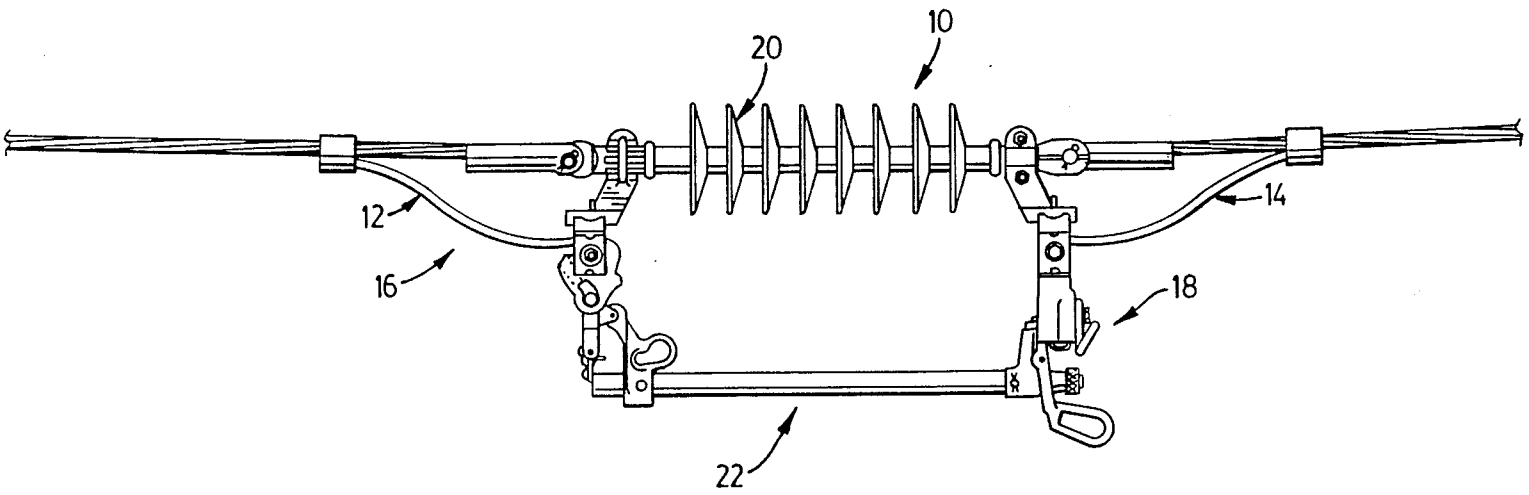
FIG. 6 is a side view of the device shown in FIG. 1 in an in-line condition.
Figure 7:
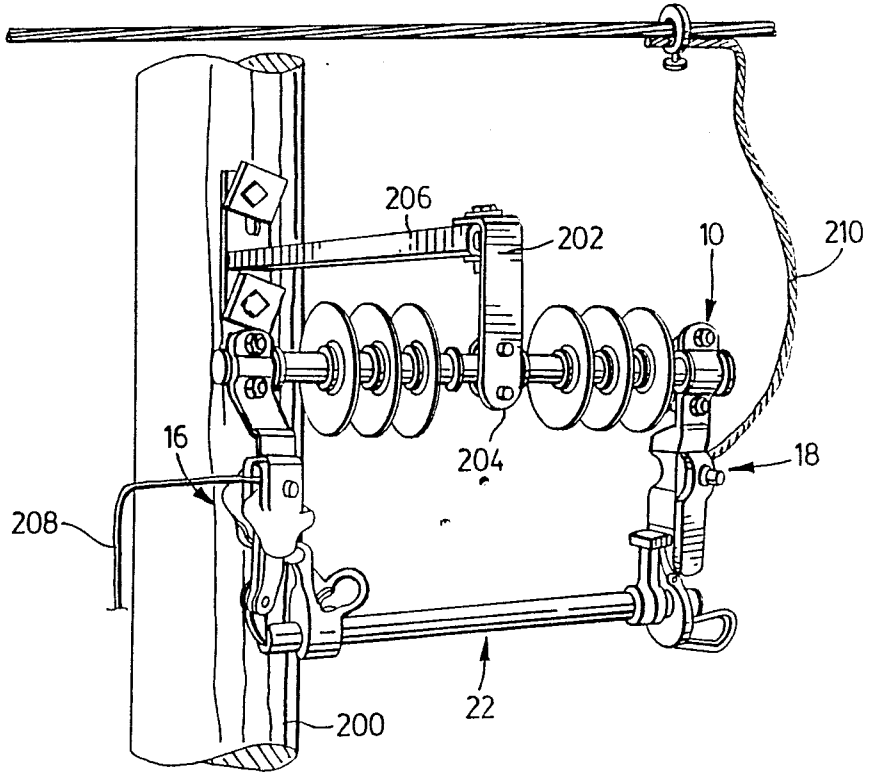
FIG. 7 is a partial perspective view of the device shown in FIG. 1 in a pole mount condition.

Referring now to FIGS. 6 and 7, the present cut-out device 10 is shown in an in-line condition and in a pole mount condition. In the in-line condition illustrated in FIG. 6, the device 10 interconnects the power lines 12 and 14 as the lines span between suitable utility supports. However, as can be seen in FIG. 7, the device 10 can also be mounted to a utility pole 200. When the device 10 is to be mounted in this fashion, a bracket 202 is secured to the insulator 20 via a "U"-bolt 204. A mounting post 206 bolted to the utility pole extends from the pole 200 and is bolted to the bracket 202. A power line 208 is connected to the terminal assembly 16 in the manner described above and extends to a consumer location or transformer. A second power line 210 extends from the terminal assembly 18 to the overhead power lines. Thus, as can be seen the present device is capable of operating in various environments.

The present device provides advantages in that since the cut-out device 10 is mounted in a substantially horizontal position with respect to the ground, vapour jettisoned from the fuse carrier 84 in the event of an overload is directed in a direction that precludes the possibility of damage to equipment or injury to a passerby. Also, since the passageways 38*a* and 38*b* are sufficiently deep and steeply angled downwardly the trunnions 94*a* and 94*b* are maintained in position in the passageways when the fuse assembly swings downwardly after releasing from the terminal assembly 18 Furthermore, the abutment surfaces 44*a* and 44*b* provide additional support for the trunnions 94*a*, 94*b* to inhibit movement of the fuse assembly 22 along its axis when in an operating position.

It should be apparent to those of skill in the art that modifications and variations can be made to the present device without departing from the scope of the invention as defined by the appended claims.

We claim:

1. An electrical cut-out device for electrically connecting a pair of power lines interconnected by a substantially horizontally mounted insulator comprising:

a pair of conductive terminals each for receiving one of said power lines, each of said terminals including securing means on one end thereof, said securing means securing each of said terminals to one end of said insulator so that said terminals extend downwardly therefrom to define outwardly and inwardly facing sides, one of said terminals having a passageway formed therein having an open end in the outwardly facing side thereof, said passageway extending steeply downwards from said open end when said one terminal is extending downwardly from said insulator, said passageway being shaped at the other end thereof to define a bearing surface;

releasable latch means located on the other of said terminals; and a fusible link connectable in a substantially horizontal operative position between said one and other terminals to connect electrically said terminals, one end of said fusible link including means for slidably engaging in said passageway when said means is aligned with said open end, said fusible link being pivotal in said passageway when said means is positioned at the other end of said passageway to engage releasably the other end of said fusible link with said latch means.

2. An electrical cut-out device as defined in claim 1 wherein said passageway terminates in a substantially vertical section to define an abutment surface to inhibit movement of said fusible link along its longitudinal axis when said fusible link is in said operative position.

3. An electrical cut-out device as defined in claim 2 further comprising a resilient retainer mounted on said one terminal and wherein said means for slidably engaging in said passageway includes a cam surface having an abutment member, said abutment member contacting said resilient retainer when said fusible link is pivoted to assume said operative position to bias said fusible link along its longitudinal axis towards said latch means.

4. An electrical cut-out device as defined in claim 3 wherein said passageway is in the form of a pair of spaced channels, said channels being angled steeply, downwardly with respect to a horizontal axis, each of said channels including a bend along a portion of its length between said one and other ends thereof and terminating in said substantially vertical section at the other end thereof, said vertical sections lying on the longitudinal axis of said one terminal and being of sufficient depth to define said abutment and bearing surfaces.

5. An electrical cut-out device as defined in claim 4 wherein said one terminal is in the form of a bifurcated member having a pair of spaced side walls, said channels being formed in the interior surfaces of the side walls and wherein said means for slidably engaging in said passageway includes a pair of outwardly extending trunnions, said trunnions being slidably engageable in said channels via said open ends when said fusible link is substantially vertically oriented.

6. An electrical cut-out device as defined in claim 5 wherein said cam surface and said channels are arranged to inhibit said fusible link from being pivoted to engage the other end of said fusible link with said latch means when said trunnions are not seated in said substantially vertical sections.

7. An electrical cut-out device as defined in claim 6 wherein said fusible link includes a lifting ring adjacent said one end thereof, said lifting ring being positioned on said fusible link so that when said fusible link is lifted via said lifting ring, said fusible link assumes said substantially vertical orientation.

8. An electrical cut-out device as defined in claim 1 wherein said fusible link includes an engagement plate located at the other end thereof and wherein said latch means includes a pair of biased retainers, said biased retainers engaging opposite sides of said engagement plate when said fusible link is in said operative position and release means for reverse biasing said biased retainers to allow said engagement plate to be released from said biased retainers.

9. An electrical cut-out device as defined in claim 8 wherein said release means is in the form of a pull-ring disposed beneath said fusible link adjacent the other end thereof to facilitate disengagement of said fusible link from said other terminal.

10. A generally horizontally mounted electrical cut-out device comprising:

an insulator for interconnecting a pair of power lines;

a pair of conductive terminals each for receiving one of said power lines, each of said terminals extending downwardly from one end of said insulator and defining outwardly and inwardly facing sides, one of said terminals having a steep, downwardly extending passageway formed therein, said passageway including an open end formed in the outwardly facing side and being shaped at the other end thereof to define a bearing surface;

releasable latch means located on the other said terminals; and a fusible link connectable in a substantially horizontal operative position between said terminals to connect electrically said terminals and one of said fusible link including means for slidably engaging in said passageway when said means is aligned with said open end, said fusible link being pivotal in said passageway when said means is positioned at the other end of said passageway to engage releasably the other end of said fusible link with said latch means.

11. An electrical cut-out device as defined in claim 10 wherein said passageway terminates in a substantially vertical section to define an abutment surface to inhibit movement of said fusible link along its longitudinal axis when said fusible link is in said operative position.

12. An electrical cut-out device as defined in claim 11 further comprising a resilient retainer mounted on said one terminal and wherein said means for slidably engaging in said passageway includes a cam surface having an abutment member, said abutment member contacting said resilient retainer when said fusible link is pivoted to assume said operative position to bias said fusible link along its longitudinal axis towards said latch means.

13. An electrical cut-out device as defined in claim 12 wherein said passageway is in the form of a pair of spaced channels, said channels being angled steeply, downwardly with respect to a horizontal axis, each of said channels including a bend along a portion of its length between said one and other ends thereof and terminating in said substantially vertical section at the other end thereof, said vertical sections lying on the longitudinal axis of said one terminal and being of sufficient depth to define said abutment and bearing surfaces.

14. An electrical cut-out device as defined in claim 13 wherein said one terminal is in the form of a bifurcated member having a pair of spaced side walls, said channels being formed in the interior surfaces of the side walls and wherein said means for slidably engaging in said passageway includes a pair of outwardly extending trunnions, said trunnions being slidably engageable in said channels via said open ends when said fusible link is substantially vertically oriented.

15. An electrical cut-out device as defined in claim 14 wherein said cam surface and said channels are arranged to inhibit said fusible link from being pivoted to engage the other end of said fusible link with said latch means when said trunnions are not seated in said substantially vertical sections.

16. An electrical cut-out device as defined in claim 15 wherein said fusible link includes a lifting ring adjacent said one end thereof, said lifting ring being positioned on said fusible link so that when said fusible link is lifted via said lifting ring, said fusible link assumes said substantially vertical orientation.

17. An electrical cut-out device as defined in claim 10 wherein said fusible link includes an engagement plate located at the other end thereof and wherein said latch means includes a pair of biased retainers, said biased retainers engaging opposite sides of said engagement plate when said fusible link is in said operative position and release means for reverse biasing said biased retainers to allow said engagement plate to be released from said biased retainers.

18. An electrical cut-out device as defined in claim 17 wherein said release means is in the form of a pull-ring disposed beneath said fusible link adjacent the other end thereof to facilitate disengagement of said fusible link from said other terminal.

19. An electrical cut-out device as defined in claims 10 or 18 further comprising attachment means extending from said insulator to permit said cut-out device to be mounted on a utility pole.

* * * * *